US006935807B2

(12) United States Patent
Becker

(10) Patent No.: US 6,935,807 B2
(45) Date of Patent: Aug. 30, 2005

(54) DEVICE FOR MAINTAINING TENSION ON LIFT CABLES

(76) Inventor: George F. Becker, 5940 Youngquist Rd., Ft. Myers, FL (US) 33912

( * ) Notice: Subject to any disclaimer, the term of this patent is extended or adjusted under 35 U.S.C. 154(b) by 0 days.

(21) Appl. No.: 10/650,517

(22) Filed: Aug. 28, 2003

(65) Prior Publication Data

US 2004/0052582 A1 Mar. 18, 2004

Related U.S. Application Data

(60) Provisional application No. 60/407,826, filed on Sep. 3, 2002.

(51) Int. Cl.[7] ..... E02C 5/00
(52) U.S. Cl. ..... 405/3; 114/48
(58) Field of Search ..... 405/3; 114/44, 114/48, 678; 254/334, 335, 336, 277; 187/259, 261, 262, 264, 265, 266, 411, 412

(56) References Cited

U.S. PATENT DOCUMENTS

| | | | | | |
|---|---|---|---|---|---|
| 2,934,211 | A | * | 4/1960 | Shivek | 211/59.3 |
| 3,191,389 | A | | 6/1965 | Poe | |
| 3,265,024 | A | | 8/1966 | Kramlich | |
| 3,504,502 | A | | 4/1970 | Blount | |
| 3,675,258 | A | | 7/1972 | Osmundson | |
| 3,778,855 | A | | 12/1973 | Kariagin et al. | |
| 3,791,229 | A | | 2/1974 | Litezki | |
| 4,337,868 | A | | 7/1982 | Gattu | |
| 4,589,800 | A | | 5/1986 | Nasby, Jr. | |
| 4,641,996 | A | | 2/1987 | Seal | |
| 4,686,920 | A | | 8/1987 | Thomas | |
| 4,954,011 | A | | 9/1990 | Stenson | |
| 4,983,067 | A | | 1/1991 | Montgomery | |
| 5,020,463 | A | | 6/1991 | Franklin et al. | |
| 5,051,027 | A | | 9/1991 | Horton | |
| 5,090,842 | A | | 2/1992 | Montgomery | |
| 5,140,923 | A | | 8/1992 | Wood | |
| 5,211,124 | A | | 5/1993 | Reiser | |
| 5,261,347 | A | | 11/1993 | Mansfield | |
| 5,287,821 | A | | 2/1994 | Godbersen | |
| 5,390,616 | A | * | 2/1995 | Roth | 114/44 |
| 5,593,247 | A | * | 1/1997 | Endres et al. | 405/3 |
| 5,687,663 | A | | 11/1997 | Wahlstrand | |
| 5,701,834 | A | | 12/1997 | Lyons | |
| D390,188 | S | | 2/1998 | Norfolk et al. | |
| 5,755,529 | A | | 5/1998 | Follett | |
| 5,769,568 | A | | 6/1998 | Parkins et al. | |

(Continued)

FOREIGN PATENT DOCUMENTS

| | | | |
|---|---|---|---|
| FR | 2622529 | * | 5/1989 |

*Primary Examiner*—Sunil Singh
(74) *Attorney, Agent, or Firm*—Edward M. Livingston; Angela M. Miller; The Livingston Firm

(57) ABSTRACT

A device for preventing the tangling or crossing of lift cables by maintaining the tension on the lift cables. When the tension is removed from lift cables (4) by placing a boat in a water body, the cables (4) become slack and can cross and/or tangle at a winderbar (1), which greatly reduces the life of the cables (4) and can cause serious damage to boatlift and boat. The present invention applies a tensioning means to the cables (4) by utilizing a weight (10) and pulley (9) or a spring (15) attached to an end of the lift cable (4). Lift cables (4) are first attached at one end to the winderbar (1). The cables (4) are then fed through the cradle (13). When using the weight (10) and pulley (4) system, the cables (4) are placed over a pulley (9) so that the weight (10) attached to the opposite end of the cable (4) maintains tension on the cables (4). The spring (15) tension means attaches the tag end of the cable (5) to the windbar (1) and the opposite end of the cable (4) is attached to a spring (15). The spring (15) is then affixed to a stationary object, such as a boatlift top beam (3) in order to maintain tension on the cables (4).

7 Claims, 2 Drawing Sheets

U.S. PATENT DOCUMENTS 5,772,360 A 6/1998 Wood, II
5,803,003 A 9/1998 Vickers
5,915,877 A 6/1999 Sargent et al.
5,934,826 A 8/1999 Mansfield
5,947,639 A 9/1999 Bishop et al.
5,957,623 A 9/1999 Sargent et al.
5,988,941 A 11/1999 Sargent et al.
6,006,687 A 12/1999 Hillman et al.
6,033,148 A 3/2000 Norfolk et al.
6,122,994 A 9/2000 Norfolk et al.

* cited by examiner

DEVICE FOR MAINTAINING TENSION ON LIFT CABLES

CROSS REFERENCE TO RELATED APPLICATION

This application claims the benefit of U.S. Provisional Application No. 60/407,826, filed Sep. 3, 2002.

BACKGROUND OF THE INVENTION

This invention relates to winch cables, and more particularly, a device for maintaining the tension on lift cables to prevent cable entanglement.

In lifting devices, such as boatlifts, a lift cable is wound around a drum which is being rotated by a self-locking gear reduction unit. Thus, the drum effectively becomes a winch spool. Ideally, the cable should wind around the drum evenly without crossing or tangling, which can only be accomplished by maintaining cable tension. The proper winding of the cables is very important for two primary reasons: 1) cross or tangled cables significantly shorten cable life and 2) cross or tangled cables may cut themselves, thereby dropping the load. Thus, it is necessary to maintain tension on the cables.

Typically there are two different cable routes used in the boatlift industry: single part line and two part line. Single part line has a weight, or tensioner, which can be affixed to the cable above the lower members, thus maintaining tension when the lower members are resting on a fixed point or when effectively lightened by bouancy or wave action. However, two part line cannot use the tensioner as described above because the cable runs through a pulley on the lower members. Thus, cabling problems remain a constant problem in the boatlift industry when using two part cables.

Currently, there are two ways to solve this problem: 1) by using cable keepers and 2) by using weighted snatch blocks. Cable keepers consist of a means of applying tension against the cable and the winder bar. A significant drawback to using this product is that if the boatlift is allowed to run once the weight is off the cable, the cable tends to protrude away from the winder. When the lift is restarted, however, the loop of cable which was formed tends to get caught under the cable keeper, often causing serious damage to the boatlift and the boat.

On the other hand, weighted snatch blocks move the pulley in the lower member to a weighted "Snatch Block" attached to the lower member by means of a cable or chain. Although the weighted snatch blocks will maintain proper cable tension, the overall length of the device and its attachments severely limits the height the boat can be raised to, making the device extremely undesirable to many boaters.

Thus, the present invention will prevent the crossing and tangling of cables by maintaining proper cable tension. In addition, the present invention will not limit the height to which the boat can be raised.

The prior art includes the following United States patents:

| U.S. Pat. No. | Inventor | Filing Date | Issue Date |
|---|---|---|---|
| 3,191,389 | Poe | Nov. 27, 1961 | Jun. 29, 1965 |
| 3,265,024 | Kramlich | Jun. 14, 1965 | Aug. 9, 1966 |
| 3,504,502 | Blount | Nov. 6, 1967 | Apr. 7, 1970 |
| 3,675,258 | Osmundson | Oct. 22, 1970 | Jul. 11, 1972 |

-continued

| U.S. Pat. No. | Inventor | Filing Date | Issue Date |
|---|---|---|---|
| 3,778,855 | Kariagin et al. | Dec. 15, 1972 | Dec. 18, 1973 |
| 3,791,229 | Litezki | May 24, 1972 | Feb. 12, 1974 |
| 4,337,868 | Gattu | Feb. 19, 1980 | Jul. 6, 1982 |
| 4,589,800 | Nasby, Jr. | Mar. 29, 1985 | May 20, 1986 |
| 4,641,996 | Seal | Sep. 20, 1984 | Feb. 10, 1987 |
| 4,686,920 | Thomas | Nov. 24, 1986 | Aug. 18, 1987 |
| 4,954,011 | Stenson | Aug. 1, 1988 | Sep. 4, 1990 |
| 4,983,067 | Montgomery | Mar. 8, 1990 | Jan. 8, 1991 |
| 5,020,463 | Franklin et al. | Dec. 18, 1989 | Jun. 4, 1991 |
| 5,051,027 | Horton | Dec. 15, 1989 | Sep. 24, 1991 |
| 5,090,842 | Montgomery | Jan. 7, 1991 | Feb. 25, 1992 |
| 5,140,923 | Wood | Mar. 25, 1991 | Aug. 25, 1992 |
| 5,211,124 | Reiser | Mar. 6, 1992 | May 18, 1993 |
| 5,261,347 | Mansfield | Jul. 22, 1992 | Nov. 16, 1993 |
| 5,287,821 | Godbersen | Apr. 12, 1993 | Feb. 22, 1994 |
| 5,390,616 | Roth | Jun. 21, 1993 | Feb. 21, 1995 |
| 5,593,247 | Endres et al. | Sep. 7, 1995 | Jan. 14, 1997 |
| 5,687,663 | Wahlstrand | Jun. 19, 1996 | Nov. 18, 1997 |
| 5,701,834 | Lyons | Aug. 26, 1996 | Dec. 30, 1997 |
| 5,755,529 | Follett | May 23, 1996 | May 26, 1998 |
| 5,769,568 | Parkins et al. | Jan. 15, 1997 | Jun. 23, 1998 |
| 5,772,360 | Wood, II | May 19, 1997 | Jun. 30, 1998 |
| 5,803,003 | Vickers | Jan. 2, 1997 | Sep. 8, 1998 |
| 5,915,877 | Sargent et al. | Jun. 4, 1997 | Jun. 29, 1999 |
| 5,934,826 | Mansfield | Jul. 9, 1998 | Aug. 10, 1999 |
| 5,947,639 | Bishop et al. | Dec. 4, 1998 | Sep. 7, 1999 |
| 5,957,623 | Sargent et al. | Feb. 12, 1998 | Sep. 28, 1999 |
| 5,988,941 | Sargent et al. | Oct. 14, 1997 | Nov. 23, 1999 |
| 6,006,687 | Hillman et al. | Jan. 21, 1998 | Dec. 28, 1999 |
| 6,033,148 | Norfolk et al. | Sep. 9, 1998 | Mar. 7, 2000 |
| 6,122,994 | Norfolk et al. | Dec. 9, 1998 | Sep. 26, 2000 |
| D 390,188 | Norfolk et al. | Jul. 15, 1996 | Feb. 3, 1998 |

SUMMARY OF THE INVENTION

The primary object of the present invention is to provide a device for maintaining tension on lift cables with or without the presence of the weight of the item being lifted.

Another object of the present invention is for the prevention of lift cables from crossing and tangling.

A further object of the present invention is to maintain cable tension when the lower lifting beams become bouyant or subject to wave action.

An even further object of the present invention is to maintain cable tension when the lower lifting beams are rested on a fixed point.

Another object of the present invention is to be easily retrofittable to any new or used cable operated boat lift.

Another object of the present invention is to maintain cable tension when installing cables on a new boat lift.

A further object of the present invention is to maintain cable tension when servicing an existing boat lift.

The present invention fulfills the above and other objects by providing a device for maintaining tension on lift cables which has a pulley and a weight or spring. The pulley will permit the cables to change direction while the weight or spring will be of sufficient size to maintain cable tension when the cable is attached to it. The cable is attached to the weight or spring and is adjustable. When the weight of the boat or cradle is removed from the boatlift, the weight or spring pulls down on the end of the cable, thereby maintaining tension. Because the boat or cradle weight is heavier than the weight attached to the machine, tension will still be maintained when the boat or cradle is replaced on the boatlift. In addition, the present invention can be used onto an existing boatlift by mounting it to the existing boatlift's top beam.

The above and other objects, features, and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to a description of a preferred embodiment with reference to the following drawings which are explained briefly as follows:

DESCRIPTION OF PREFERRED EMBODIMENT

Listed numerically below with reference to the drawings are terms used to describe features of this invention. These terms and numbers assigned to them designate the same features throughout this description.

Figure 1:
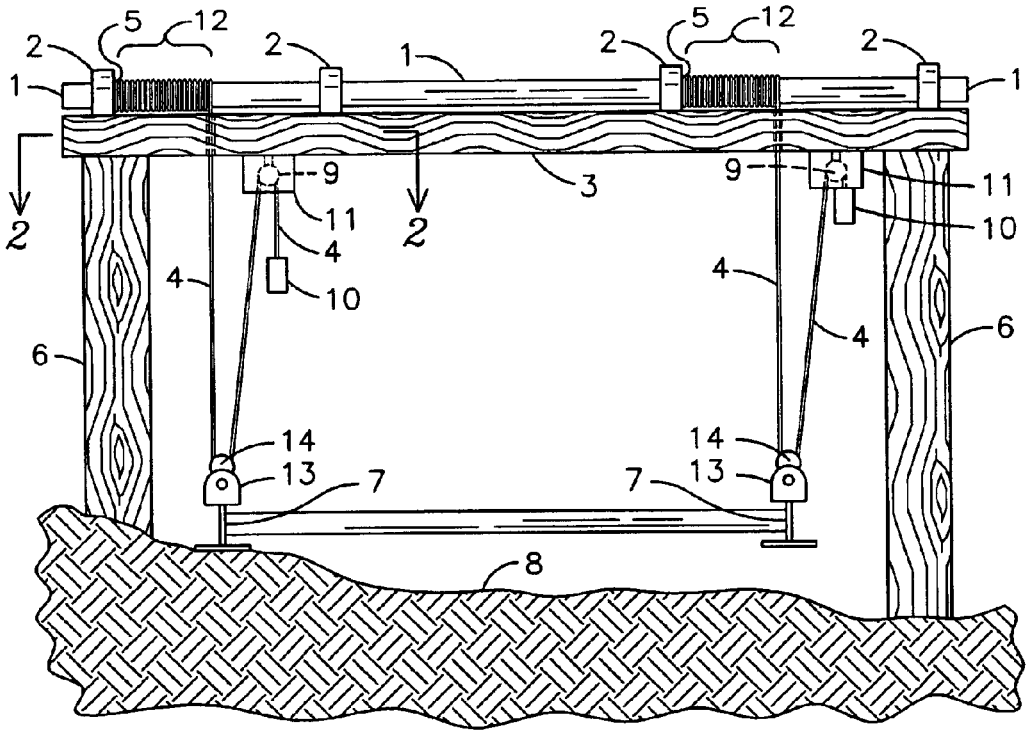
FIG. 1 is a side view of the present invention installed on a boatlift using a weight tension means.

1. winder bar
2. driveshaft bearing
3. top beam
4. cable
5. tag end of cable
6. vertical piling
7. cradle beam
8. bottom
9. pulley
10. weight
11. stop
12. winch spool
13. cradle
14. windlass
15. spring With reference to FIG. 1, a side view of the present invention installed on a boatlift where the tension means applied is a weight 10. Although one end of the cradle beam 7 is resting on the bottom and the other end of the cradle beam 7 is suspended, tension on the cables 4 is maintained at both ends by using a weight 10. The stationary top beam 3 of the boatlift is supported by vertical pilings 6. The winderbar 1 is attached to the top beam 3 by using driveshaft bearings 2. The tag ends of a cable 5 are attached to the winderbar 1 so that when the winderbar 1 rotates, a winch spool 12 is created so the cables 4 wrap around the winderbar 1 without overlapping. The cables 4 that are not wrapped continue downward through a hole in the top beam 3 to slide under the windlass 14 affixed to a cradle 13. The cable 4 then continues upward so as to feed over the pulley 9 which is affixed to a stop 11, preferably by screws. The stop 11 houses the pulley 9 and is affixed to the top beam 3, preferably by bolts. A weight 10 is attached to the end of the cables 4. When the cradle beam 7 is resting on the bottom 8, the weight 10 is not pressed against the stop 11 although tension is still maintained in the cables 4. When the cradle beam 7 is suspended, the weight 10 rises to press against the stop 11 to maintain tension in the cables 4.

Figure 2:
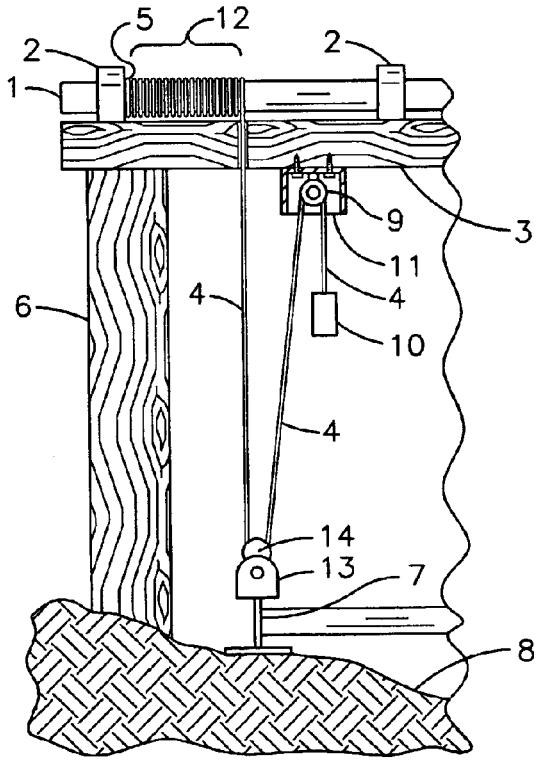
FIG. 2 is a cross sectional view along the line 2—2 of the embodiment of FIG. 1.

In FIG. 2, a cross sectional view along the line 2—2 of the embodiment of FIG. 1 is shown. The cable 4, attached to the winch spool 12 on one end and having a weight 10 attached to the other, is fed over a pulley 9 located in the stop 11. Both the pulley 9 and the stop 11 are attached to the top beam 3, preferably by using bolts.

Figure 3:
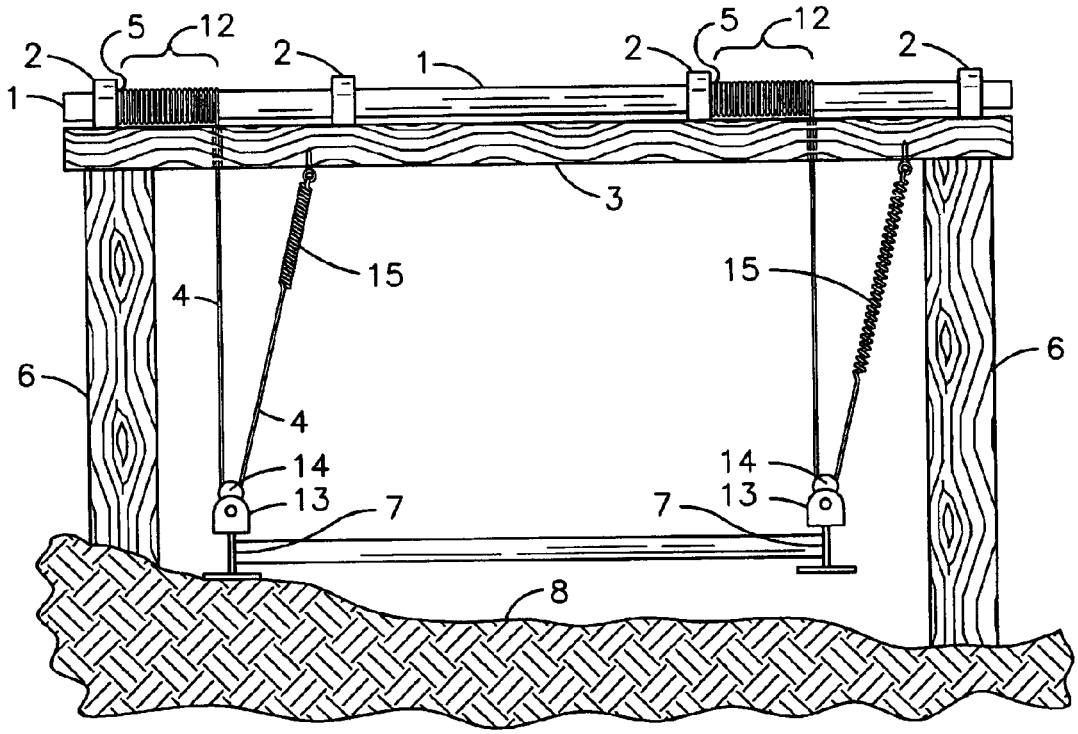
FIG. 3 is a side view of the present invention installed on a boatlift using a spring tension means and the cradle beam is resting.

Referring to FIG. 3, the present invention installed on a boatlift is shown where the tension means applied is a spring 15 and the cradle beam 7 is resting on the bottom 8. As in the previous figures, the tag end of the cable 5 is attached to the windbar 1 so that when the winderbar 1 rotates, a winch spool 12 is created so the cables 4 wrap around the winderbar 1 without overlapping. The cables 4 that are not wrapped continue downward through a hole in the top beam 3 to slide under the windlass 14 affixed to a cradle 13. When using a spring 15 tension means, however, the opposite end of the cable 4 is attached to a spring 15, rather than a weight 10. The opposite end of the spring 15 is then attached to a stationary object, such as the top beam 3, preferably by using bolts. When the cradle beam 7 is resting on the bottom 8, the spring 15 is stretched from its coiled position so as to maintain tension in the cable 4.

Figure 4:
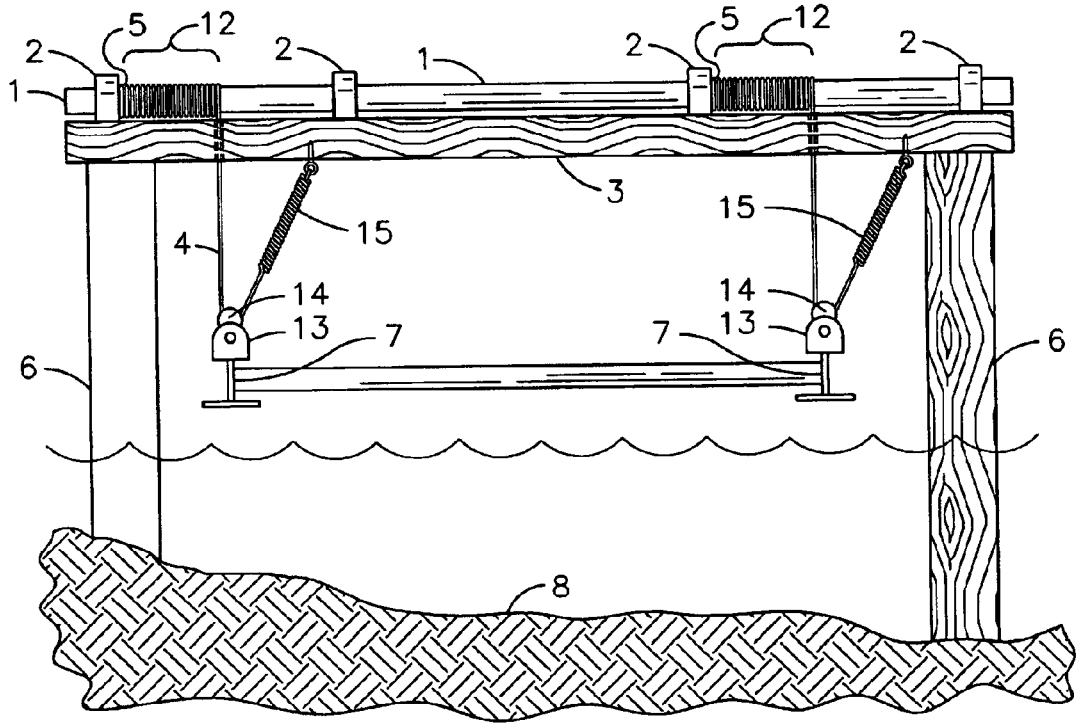
FIG. 4 is a side view of the present invention installed on a boatlift using a spring tension means and the cradle beam is suspended.

With reference to FIG. 4, the present invention installed on a boatlift is shown where the tension means applied is a spring 15 and the cradle beam 7 is suspended. The spring 15 returns to its coiled position to maintain tension in the cables 4.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

Having thus described my invention, I claim:

1. A device for maintaining tension on lift cables comprising:

a lift cable having a first end affixed to a winder bar on a lift;

said lift cable having a second end affixed to a movable tension means;

said lift cable wraps around said winder bar to create a winch spool;

said lift cable slides under a windlass affixed on a cradle arm; and said movable tension means is a weight attached to the second end of the lift cable and a pulley affixed to an underside of said lift.

2. The device of claim 1 wherein:

said weight is at least of minimum weight to keep said cable taut;

said pulley is sized to accommodate a width of said cable; and said pulley is rotatable about a fixed point.

3. The device of claim 1 wherein:

said lift cable slides over said pulley.

4. The device of claim 1 wherein:

said pulley is surrounded by a stop;

said stop is affixed to said lift; and said stop is at least of minimum size needed to stop the movement of said movable tension means.

5. The device of claim 1 wherein:

said lift cable length is adjustable.

6. A device for maintaining tension on lift cables comprising:

a lift cable having a first end affixed to a winder bar on a lift;

said lift cable having a second end affixed to a movable tension means;

said lift cable wraps around said winder bar to create a winch spool;

said lift cable slides under a windlass affixed on a cradle arm; and said movable tension means is a spring connected to a top beam of said lift.

7. The device of claim 6 wherein:

said spring is of sufficient resiliency as to keep said cable taut.

* * * * *